United States Patent [19]

Moskowitz et al.

[11] Patent Number: 4,869,936

[45] Date of Patent: Sep. 26, 1989

[54] APPARATUS AND PROCESS FOR PRODUCING HIGH DENSITY THERMAL SPRAY COATINGS

[75] Inventors: Larry N. Moskowitz; Donald J. Lindley, both of Naperville, Ill.

[73] Assignee: Amoco Corporation, Chicago, Ill.

[21] Appl. No.: 138,815

[22] Filed: Dec. 28, 1987

[51] Int. Cl.[4] ..... B05D 1/08

[52] U.S. Cl. ..... 427/423; 118/47; 239/79; 239/81; 239/85; 239/290; 239/296; 239/405

[58] Field of Search ..... 118/47; 239/79, 89, 239/85, 290, 296, 405; 427/423

[56] References Cited

U.S. PATENT DOCUMENTS

| | | | |
|---|---|---|---|
| 3,470,347 | 9/1969 | Jackson | 219/76 |
| 3,664,804 | 5/1972 | Flournoy | 239/405 |
| 3,892,882 | 7/1975 | Guest | 427/34 |
| 4,090,666 | 5/1978 | Peck | 118/629 |
| 4,266,113 | 5/1981 | Denton et al. | 219/121 |
| 4,370,538 | 1/1983 | Browning | 219/121 PY |
| 4,416,421 | 11/1983 | Browning | 239/79 |
| 4,540,121 | 9/1985 | Browning | 239/81 |
| 4,593,856 | 6/1986 | Browning | 427/423 |
| 4,634,611 | 1/1987 | Browning | 427/423 |
| 4,668,534 | 5/1987 | Gray | 118/315 |
| 4,674,683 | 6/1987 | Fabel | 239/81 |
| 4,684,296 | 8/1987 | Horii | 239/405 |

FOREIGN PATENT DOCUMENTS

| | | | |
|---|---|---|---|
| 1199278 | 12/1985 | U.S.S.R. | 239/85 |

*Primary Examiner*—Shrive Beck
*Assistant Examiner*—Vi Duong Dang
*Attorney, Agent, or Firm*—Bruce A. Walker; Frank Sroka; William M. Magidson

[57] ABSTRACT

An attachment for supersonic thermal spray equipment by which inert shield gas is directed radially outwardly about the central core of a supersonic, particle-carrying flame to isolate the same from ambient atmosphere. The shield gas is injected tangentially against the inner surface of a constraining tube attached to and extending from the discharge end of the thermal spray gun nozzle, causing the shield gas to assume a helical flow path which persists until after it exits the tube and impacts the work piece. A process using the shielding apparatus with a high-velocity, thermal spray gun and employing oxygen and hydrogen as gases of combustion and inert gas to introduce metal powder, having a narrow particle size distribution and low oxygen content, into the high-velocity combustion gases, produces significantly improved, high-density, low-oxide metal coatings on a substrate.

26 Claims, 4 Drawing Sheets

APPARATUS AND PROCESS FOR PRODUCING HIGH DENSITY THERMAL SPRAY COATINGS

This invention relates to thermal spraying and more particularly to improved apparatus for shielding a supersonic-velocity particle-carrying flame from ambient atmosphere and an improved process for producing high-density, low-oxide, thermal spray coatings on a substrate.

Thermal spraying technology involves heating and projecting particles onto a prepared surface. Most metals, oxides, cermets, hard metallic compounds, some organic plastics and certain glasses may be deposited by one or more of the known thermal spray processes. Feedstock may be in the form of powder, wire, flexible powder-carrying tubes or rods depending on the particular process. As the material passes through the spray gun, it is heated to a softened or molten state, accelerated and, in the case of wire or rod, atomized. A confined stream of hot particles generated in this manner is propelled to the substrate and as the particles strike the substrate surface they flatten and form thin platelets which conform and adhere to the irregularities of the previously prepared surface as well as to each other. Either the gun or the substrate may be translated and the sprayed material builds up particle by particle into a lamellar structure which forms a coating. This particular coating technique has been in use for a number of years as a means of surface restoration and protection.

Known thermal spray processes may be grouped by the two methods used to generate heat namely, chemical combustion and electric heating. Chemical combustion includes powder flame spraying, wire/rod flame spraying and detonation/explosive flame spraying. Electrical heating includes wire arc spraying and plasma spraying.

Standard powder flame spraying is the earliest form of thermal spraying and involves the use of a powder flame spray gun consisting of a high-capacity, oxy-fuel gas torch and a hopper containing powder or particulate to be applied. A small amount of oxygen from the gas supply is diverted to carry the powder by aspiration into the oxy-fuel gas flame where it is heated and propelled by the exhaust flame onto the work piece. Fuel gas is usually acetylene or hydrogen and temperatures in the range of 3000°–4500° F. are obtained. Particle velocities are in the order of 80–100 feet per second. The coatings produced generally have low bond strength, high porosity and low overall cohesive strength.

High velocity powder flame spraying was developed about 1981 and comprises a continuous combuation procedure that produces exit gas velocities estimated to be 4000–5000 feet per second and particle speeds of 1,800–2,600 feet per second. This is accomplished by burning a fuel gas (usually propylene) with oxygen under high pressure (60–90 psi) in an internal combustion chamber. Hot exhaust gases are discharged from the combustion chamber through exhaust ports and thereafter expanded into an extending nozzle. Powder is fed axially into this nozzle and confined by the exhaust gas stream until it exits in a thin high speed jet to produce coatings which are far more dense than those produced with conventional or standard powder flame spraying techniques.

Wire/rod flame spraying utilizes wire as the material to be deposited and is known as a "metallizing" process.

Under this process a wire is continuously fed into an oxy-acetylene flame where it is melted and atomized by an auxiliary stream of compressed air and then deposited as the coating material on the substrate. This process also lends itself to the use of other materials, particularly brittle ceramic rods or flexible lengths of plastic tubing filled with powder. Advantage of the wire/rod process over powder flame spraying lies in its use of relatively low-cost consumable materials as opposed to the comparatively high-cost powders.

Detonation/explosive flame spraying was introduced sometime in the mid 1950's and developed out of a program to control acetylene explosions. In contrast to the thermal spray devices which utilize the energy of a steady burning flame, this process employs detonation waves from repeated explosions of oxy-acetylene gas mixtures to accelerate powder particles. Particulate velocities in the order of 2,400 feet per second are achieved. The coating deposits are extremely strong, hard, dense and tightly bonded. The principle coatings applied by this procedure are cemented carbides, metal/carbide mixtures (cermets) and oxides.

The wire arc spraying proces employs two consumable wires which are initially insulated from each other and advanced to meet at a point in an atomizing gas stream. Contact tips serve to precisely guide the wires and to provide good electrical contact between the moving wires and power cables. A direct current potential difference is applied across the wires to form an arc and the intersecting wires melt. A jet of gas (normally compressed air) shears off molten droplets of the melted metal and propels them to a substrate. Spray particle sizes can be changed with different atomizing heads and wire intersection angles. Direct current is supplied at potentials of 18–40 volts, depending on the metal or alloy to be sprayed; the size of particle spray increasing as the arc gap is lengthened with rise in voltage. Voltage is therefore maintained at the lowest level consistent with arc stability to provide the smallest particles and smooth dense coatings. Because high arc temperatures (in excess of 7,240° F.) are encountered, electric-arc sprayed coatings have high bond and cohesive strength.

The plasma arc gun development has the advantage of providing much higher temperature with less heat damage to a work piece, thus expanding the range of possible coating materials that can be processed and the substrates upon which they may be sprayed. A typical plasma gun arrangement involves the passage of a gas or gas mixture through a direct current arc maintained in a chamber between a coaxially aligned cathode and water-cooled anode. The arc is initiated with a high frequency discharge. The gas is partially ionized creating a plasma with temperatures that may exceed 30,000° F. The plasma flux exits the gun through a hole in the anode which acts as a nozzle and its temperature falls rapidly with distance. Powdered feed-stock is introduced into the hot gaseous effluent at an appropriate point and propelled to the workpiece by the high-velocity stream. The heat content, temperature and velocity of the plasma gas are controlled by regulating arc current, gas flow rate, the type and mixture ratio of gases and by the anode/cathode configuration.

Up until the early 1970's commercial plasma spray systems used power of about 5–40 kilowatts and plasma gas velocities were generally subsonic. A second generation of equipment was then developed known as hig energy plasma spraying which employed power input of around 80 kilowatts and used converging-diverging nozzles with critical exit angles to generate supersonic gas velocities. The higher energy imparted to the powder particles results in significant improvement in particle deformation characteristics and bonding and produces more dense coatings wiht higher interparticle strength.

Recently, controlled atmosphere plasma spraying has been developed for use primarily with metal and alloy coatings to reduce and, in some cases, eliminate oxidation and porosity. Controlled atmosphere spraying can be accomplished by using an inert gas shroud to shield the plasma plume. Inert gas filled enclosures also have been used with some success. More recently a great deal of attention has been focused on "low pressure" or vacuum plasma spray methods. In this latter instance the plasma gun and work piece are installed inside a chamber which is then evacuated with the gun employing argon as a primary plasma gas. While this procedure has been highly successful in producing the deposition of thicker coats, improved bonding and deposit efficiency, the high costs of the equipment thus far have limited its use.

Related to the "low pressure" development is U.S Pat. No. 3,892,882 issued July 1, 1975, to Union Carbide Corporation, New York, N.Y. by which a subatmospheric inert gas shield is provided about a plasma gas plume to achieve low deposition flux and extended stand-off distances in a plasma spray process.

Aside from the few exceptions noted in the heretofore briefly described thermal spraying processes, all encounter some degree of oxidation of coating materials when carried out in ambient atmosphere conditions. In spraying metals and metal alloys, it is most desirable to minimize the pick-up of oxygen as much as possible. Soluble oxygen in metallic alloys increases hardness and brittleness while oxide scales on the powder and inclusions in the coating lead to poorer bonding, increased crack sensitivity and increased susceptibility to corrosion.

BRIEF DESCRIPTIION OF THE INVENTION

The discoveries and developments of this invention pertain in particular to high-velocity thermal spray equipment and a process for achieving low-oxide, dense metal coatings therewith. In one aspect the present invention comprises accessory apparatus preferably attachable to the nozzle of a supersonic-velocity thermal spray gun, preferably of the order developed by Browning Engineering, Hanover, New Hampshire and typified, for example, by the gun of U.S. Pat. No. 4,416,421 issued Nov. 22, 1983, to James A. Browning. That patent discloses the features of a high-velocity thermal spray apparatus using oxy-fuel (propylene) products of combustion in an internal combustion chamber from which the hot exhaust gases are discharged and then expanded into a water-cooled nozzle. Powder metal particles are fed into the exhaust gas stream and exit from the gun nozzle in a supersonic-speed jet stream.

In brief, the apparatus of this invention comprises an inert gas shield confined within a metal shroud attachment which extends coaxially from the outer end of a thermal spray gun nozzle. The apparatus includes an inert gas manifold attached to the outer end of the gun nozzle, means for introducing inert gas to the manifold at pressures of substantially 200–250 psi, means for mounting the manifold coaxially of the gun's nozzle and a plurality of internal passageways exiting to a series of shield gas nozzles disposed in a circular array and arranged to discharge inert gas in a pattern directed substantially tangentially against the inner wall of the shroud, radially outwardly of the gun's flame jet.

By operating the high-velocity thermal spray gun in accordance with the process of this invention, total volume fractions of porosity and oxide, as exhibited by conventional metallic thermal spray coatings, are substantially reduced from the normal range of 3–50% to a level of less than 2%. The process is performed in ambient atmosphere without the use of expensive vacuum or inert gas enclosures as employed in existing gas-shielding systems of the thermal spraying art. Procedural constraints of this process include employment of metal powders of a narrow size distribution, normally between 10 and 45 microns; the powder having a starting oxygen content of less than 0.18 per cent by weight. Combustion gases utilized in a flame spray gun under the improved process are hydrogen and oxygen which are fed to the combustion chamber at pressures in excess of 80 psi in order to obtain minimum oxygen flow rates of 240 liters/minute and a preferred ratio of 2.8–3.6 to 1, hydrogen to oxygen flow rates. These flow rates establish a distinct pattern of supersonic shock diamonds in the combustion exhaust gases exiting from the gun nozzle, indicative of sufficient gas velocity to accelerate the powder to supersonic velocities in the neighborhood of 1,800–2,600 feet per second. Inert gas carries the metal powder into the high velocity combustion gases at a preferred flow rate in the range of 48–90 liters/minute. Relative translating movement between gun and substrate is in the order of 45–65 feet per minute with particle deposition at a rate in the order of 50–85 grams/minute. Coatings produced in accordance with this procedure are uniform, more dense, less brittle and more protective than those obtained by conventional high velocity thermal spray methods.

It is a principle object of this invention to provide a new and improved apparatus for use with supersonic-velocity thermal spraying equipment which provides a localized inert gas shield about the particle-carrying flame.

Another important object of this invention is to provide an improved attachment for supersonic-velocity thermal spray guns which provides an inert-gas shield concentrically surrounding the particle-carrying exhaust gases of the gun and is operable to materially depress oxidation of such particles and the coatings produced therefrom.

Still another object of this invention is to provide a supersonic thermal spray gun with an inert-gas shield having a helical-flow pattern productive of minimal turbulent effect on the particle-carrying flame.

A further important object of this invention is to provide apparatus for effecting a helical-flow, inert-gas shield about a high-velocity exhaust jet of a thermal spray gun in which the inert shield gases are directed radially outwardly of the exhaust gases against a confining concentric wall extending coaxially of the spray-gun nozzle.

A further important object of this invention is to provide improved apparatus for a high-velocity exhaust jet of a thermal-spray gun which provides an inert-gas shield about the particle-carrying jet without limiting portability of the spray equipment.

Still a further important object of this invention is to provide an improved process for achieving high-density, low-oxide metal coatings on a substrate by use of supersonic-velocity, thermal-spray equipment operating in ambient air.

Another important object of this invention is to provide an improved process for forming high-velocity, thermal-spray coatings on substrate surfaces which exhibit significant improvements in density, cleanliness and uniformity of particle application.

Having described this invention, the above and further objects, features and advantages thereof will appear from time to time from the following detailed description of a preferred embodiment thereof, illustrated in the accompanying drawings and representing the best mode presently contemplated for enabling those with skill in the art to practice this invention.

IN THE DRAWINGS

DESCRIPTION OF THE PREFERRED EMBODIMENT

The descriptive materials which follow will initially detail the combination and functional relationship of parts embodied in the inert gas shroud apparatus followed by the features of the improved process according to this invention.

APPARATUS

Figure 2:
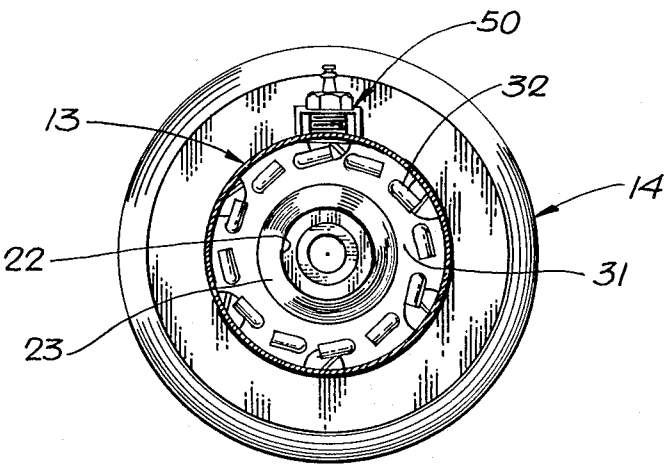
FIG. 2 is an end elevation of the shroud apparatus shown in FIG. 1.
Figure 1:
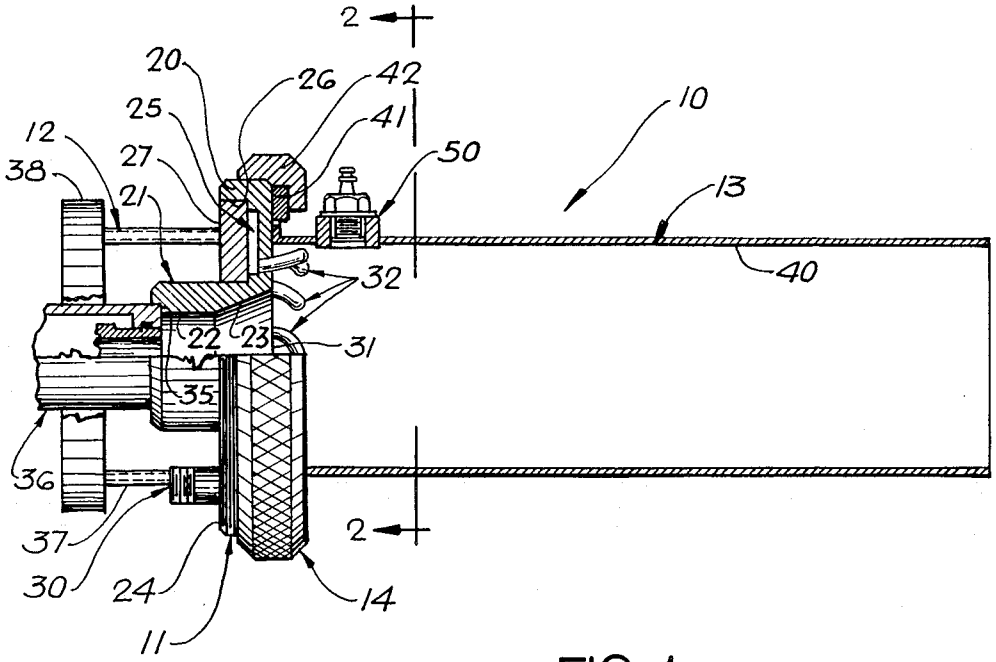
FIG. 1 is an enlarged side elevation, with parts in section, of a shroud apparatus according to this invention.

Turning to the features of the apparatus for shielding a supersonic-velocity particle-carrying exhaust jet from ambient atmosphere, initial reference is made to FIGS. 1 and 2 which illustrate a shielding apparatus, indicated generally by numeral 10, comprising gas manifold means 11, connector means 12 for joining the manifold means 11 to the outer end of a thermal spray gun barrel, constraining tube means 13, and coupling means 14 for interjoining the manifold means 11 and constraining tube means 13 in coaxial concentric relation.

Manifold means 11 comprises an annular metal body 20 having an integral cylindrical stem portion 21 extending coaxially from one end thereof and formed with an interior cylindrical passageway 22 communicating with a coaxial expanding throat portion 23 of generally frusto-conical configuration. The manifold body 20 has external threads 24 and is machined axially inwardly of its operationally rearward face to provide an annular internal manifold chamber 25 concentric with a larger annular shouldered recess 26 respective of an annular closure ring 27 which is pressed into recess 26 to enclose the chamber 25 in gas tight relationship. A pipe fitting 30 is threadingly coupled with the annular closure member 27 for supplying inert shield gas to chamber 25 which acts as a manifold for distributing the gas. A plurality of openings (unnumbered) are formed through the front wall 31 of the manifold body 20 to communicate with the manifold chamber 25; such openings each communicating with one of a plurality of nozzles 32 arrayed in a circular pattern concentrically about the central axis of the manifold body 20 and shown herein as tubular members extending outwardly of face 31. Twelve nozzles 32 are provided in the particular illustrated embodiment (see FIG. 2). Each nozzle 32 is formed of thin wall metal tubing of substantially 3/32" outside diameter having a 90° bend therein, outwardly of the manifold front wall 31. Such nozzles preferably are brazed to the manifold and positioned in a manner to direct gas emitting therefrom tangentially outward of the circle in which they are arrayed, as best illustrated in FIG. 2 of the drawings.

The opposite end of the manifold body from which the several nozzles 32 project, particularly, the outer end of the cylindrical stem portion 21 thereof, is counterbored at one end of passageway 22 to provide a shouldered recess 35 receptive of the outer end of the spray gun barrel 36 so as to concentrically pilot or center the manifold on the barrel of the gun.

The annular closure member 27 of the manifold means 11 is tapped and fitted with three extending studs 37 disposed at 120° intervals to form the attachment means 12 for coupling the manifold means 11 to the spray gun barrel. In this regard it will be noted that the studs 37 are joined to a clamp ring 38 fastened about the exterior of the spray gun barrel 36, thereby coupling the manifold means 11 tightly over the outer end of the gun barrel.

The constraining tube means 13 preferably comprises an elongated cylindrical stainless steel tube 40 having a substantially 2 inch internal diameter and fitted with an annular outwardly directed flange 41 at one base end thereof whereby the contraining tube is adapted for connection coaxially of the manifold means 11. Such interconnection with the manifold is provided by an internally threaded annular locking ring 42 which fits over flange 41 and is threadingly engageable with the external threads 24 on the the manifold body 20. Preferably the flange 41 is sealed with wall 31 of the manifold body by means of an elastomeric seal such as an O-ring (not shown).

A glow plug ignitor 50 preferably extends through the cylindrical wall of the constraining tube 40 for igniting the combustion gases employed in the flame spray gun. Alternatively the glow plug 50 may be located in the cylindrical hub portion 21 of the manifold means 11. Utilization of the glow plug enhances operational safety of the spray gun.

With the foregoing arrangement it will be noted that apparatus 10 is adapted and arranged for demountable attachment to the outer end of the high-velocity, thermal-spray gun. The length of the constraining tube is determined by the required spraying distance. Preferably tube 40 is between 6–9 inches in length with the outer end thereof operationally located between ½ to 7 inches from the work surface to be coated. The provision of the several inert gas nozzles 32 and the arrangement thereof to inject inert shielding gas near the inner surface of the constraining tube 40 and in a direction tangential to such inner surface, causes the shield gas to assume a helical-flow path within the tube and thereafter until it impacts the work piece whereupon it mixes with the ambient atmosphere.

Introduction of the inert gas tangentially of the inner surface of the constraining tube keeps the bulk of the gas near the constraining and away from the central high velocity flame plume. This minimizes energy exchange between the particle-carrying plume and the inert gas while maintaining the inert gas concentrated about the area where the powder is being applied to a substrate. The cold inert gas also serves to reduce the temperature of the constraining tube to a value which allows it to be made of non-exotic materials, such as steel.

Figure 3:
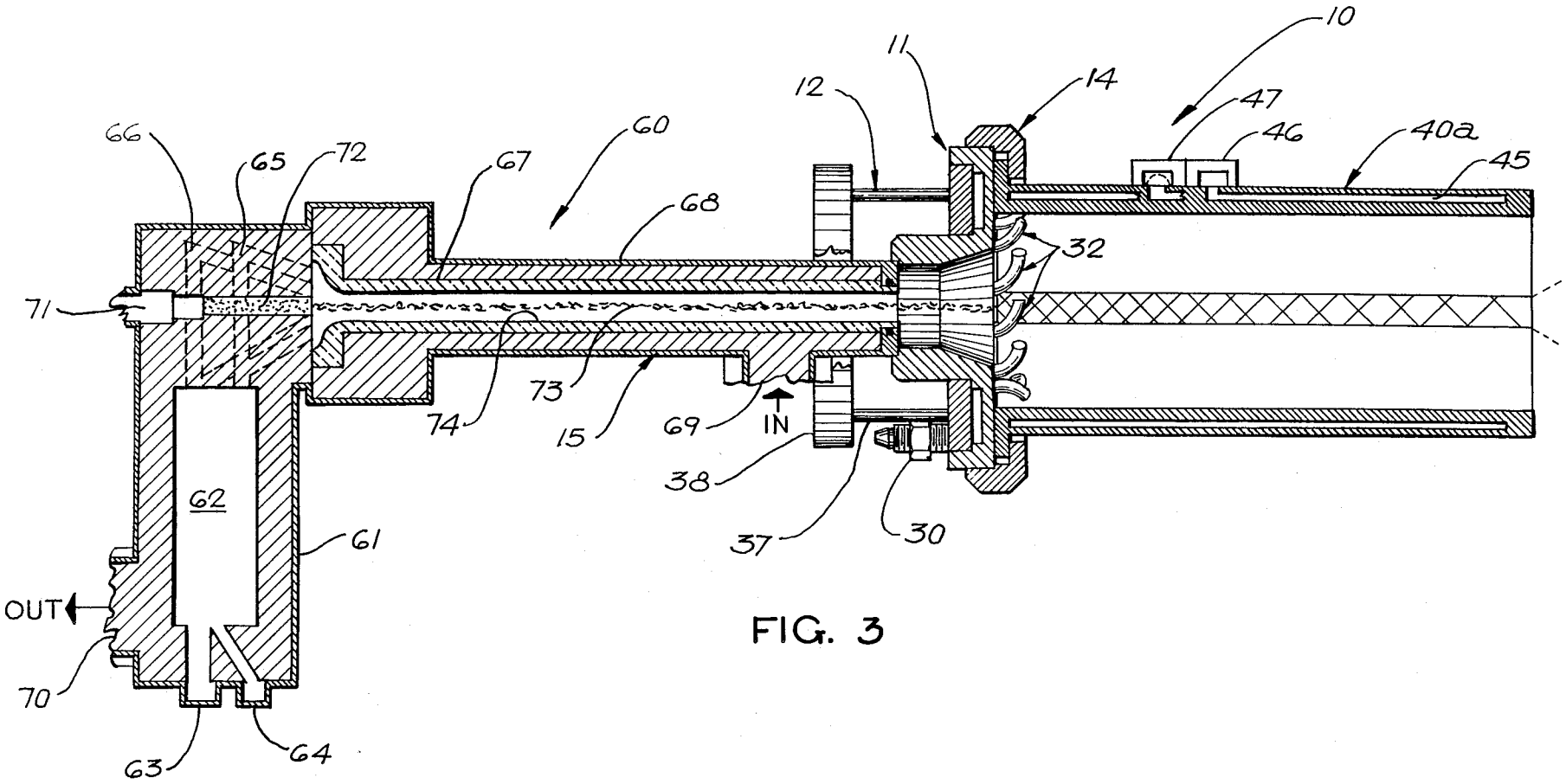
FIG. 3 is a schematic illustration of a supersonic flame spray gun assembled with a modified water-cooled shroud apparatus according to this invention.

In the modified embodiment illustrated in FIG. 3, the constraining tube 40a comprises a double-walled structure having plural internal passageways 45 which communicate with inlet and outlet fittings 46 and 47, respectively, for circulation of cooling water. In this manner the modified tube 40a is provided with a water-cooled jacket for maintaining tube temperatures at desirable operating levels.

With further reference to FIG. 3 of the drawings the assembly of the shroud apparatus 10 with typical supersonic-velocity thermal spray equipment will now be set forth.

As there shown, a supersonic-velocity, flame-spray gun of the order disclosed in U.S. Pat. No. 4,416,421 issued to James A. Browning on Nov. 22, 1983 is indicated generally by numeral 60. Flame-spray guns of this order are commercially available under the Trademark JET-KOTE II, from Stoody Deloro Stellite, Inc., of Goshen, Ind.

As schematically indicated, the gun assembly 60 comprises a main body 61 enclosing an internal combustion chamber 62 having a fuel gas inlet 63 and an oxygen inlet 64. Exhaust passageways 65, 66 from the upper end of the combustion chamber 62 direct hot combustion gases to the inner end of an elongated nozzle member 67 formed with a water-cooling jacket 68 having cooling water inlet 69 adjacent the outer end of the nozzle member 67. In the particular illustrated case, the circulating cooling water in jacket 68 also communicates with a water cooling jacket about the combustion chamber 62; water outlet 70 thereof providing a circulatory flow of water through and about the nozzle member 67 and the combustion chamber of the gun.

As previously indicated, the hot exhaust gases exiting from combustion chamber 62 are directed to the inner end and more particularly to the restricting throat portion of the nozzle member 67. A central passageway means communicates with the nozzle for the introduction of nitrogen or some other inert gas at inlet 71 to transport particulate or metal powders 72 coaxially of the plume of exhaust gases 73 travelling along the interior of the generally cylindrical passageway 74 of the nozzle member.

As noted heretofore, the shroud apparatus 10 is mounted over the outer end of the spray gun barrel concentrically of the nozzle passageway 74; being attached thereto by clamp ring 38 secured about the exterior of the water jacket 68. High-velocity exhaust gases carrying particulate material, such as metal powder, to be deposited as a coating on a substrate, pass coaxially along the gun nozzle, through the manifold means 11 and along the central axial interior of the constraining tube member 40a of FIG. 3 or the non-jacketed tube 40 of FIG. 2. The inert gas introduced into manifold means 11 exits via the several nozzles 32 to effect a helical swirling gas shield about the central core of the high-velocity, powder-containing exhaust jet, exiting from the outer end of the gun nozzle. As the flame exits the gun nozzle 67 it is travelling at substantially Mach 1 or 1,100 feet per second at sea level ambient, after which it is free to expand, principally in an axial direction within the constraining tube 40 or 40a, to produce an exit velocity at the outer end of the constraining tube of substantially Mach 4 or 4,000–5,000 feet per second, producing particle speeds in the order of 1,800–2,600 feet per second.

In contrast to existing inert gas shielding systems for thermal spraying apparatus which rely heavily on flooding the region near the flame with inert gas, the radially-constrained, helical inert gas shield provided by the apparatus of this invention avoids such waste of shield gas and the tendency to introduce air into the jet plume by turbulent mixing of the inert gas and air with the exhaust gases. In other instances, as in U.S. Pat. No. 3,470,347 issued Sept. 30, 1969 to J. E. Jackson, inert gas shields of annular configuration flowing concurrently about the jet flame have been employed. However, experience with that type of annular non-helical flow configuration for the colder inert gas shield shows marked interference with the supersonic free expansion of the jet plume by virtue of the surrounding lower velocity dense inert gas. By introducing pressurized inert gas with an outwardly directed radial component so as to direct the inert gas flow tangentially against the inner walls of the constraining tube, as in the described apparatus of this invention, minimum energy exchange occurs between the high velocity jet plume and the lower velocity inert gas while maintaining the inert gas shield concentrated about the area where the powder is eventually applied to the substrate surface. In other words, the helical flow pattern of the inert gas shield provided by apparatus 10 of this invention shields the coating particulate from the ambient atmosphere without materially decelerating the supersonic-velocity, particle-carrying exhaust jet or plume.

To validate the operational superiority of the shroud apparatus as taught herein, high speed video analysis of the shielding apparatus without the thermal jet shows a dense layer of inert gas adjacent the constraining tube and very little inert gas in the center of the tube, which normally would be occupied by the jet gases. Similar analyses show a well established helical flow pattern when using a shroud with the 90° nozzles hereinabove described while turbulent mix flow occurs all the way across the constraining tube if a concurrent flow shroud is provided in accordance with the aforenoted Jackson U.S. Pat. No. 3,470,347. Comparative tests of no shroud, the helical flow shroud hereof, and concurrent flow shroud are tabulated below. These test show lower total oxygen and lower oxide inclusion levels in coatings applied with the helical flow shroud. Both concurrent and helical flow shroud systems show lower total oxygen and oxide levels than in coatings achieved without any inert gas shielding.

SHROUD v. NO SHROUD

| Specimen No. | Description | Coating Oxygen Content | Material |
|---|---|---|---|
| #208A | Non-Helical Shroud (200 psi Ar) | 2.61% | Hastelloy C TM |
| #203B | "Control" - (identical to #208A except without shroud) | 3.17% | Hastelloy C TM |
| #208B | Non-Helical Shroud (200 psi Ar) | 2.31% | Hastelloy C TM |
| #204A | "Control" - (identical to #208B except without shroud) | 3.13% | Hastelloy C TM |
| #282A | Helical Shroud (200 psi Ar) | 0.54% | Hastelloy C TM |
| #281A | "Control" (identical to #282A except without | 1.91% | Hastelloy C TM |

-continued

| SHROUD v. NO SHROUD | | | |
|---|---|---|---|
| Specimen No. | Description | Coating Oxygen Content | Material |
| | shroud) | | |

Process

The improved process of this invention is directed to the production by thermal spray equipment of extremely clean and dense metal coatings; the spray process being conducted in ambient air without the use of expensive vacuum or inert gas enclosures.

As noted heretofore the process of this invention preferably employs a high velocity thermal spray apparatus such as the commercially available JET KOTE II spray gun of the order illustrated in FIG. 3, for example, but modified with the shroud apparatus as heretofore described and applying particular constraints on its mode of operation.

According to this invention, hydrogen and oxygen are used as combustion gases in the thermal spray gun. The $H_2/O_2$ mass flow ratio has been found to be the most influential parameter affecting coating quality, when evaluated for oxide content, porosity, thickness, surface roughness and surface color; the key factors being porosity and oxide content. Of these two gases, oxygen is the most critical in achieving supersonic operating conditions. To this end it has been determined that a minimum $O_2$ flow of substantially 240 liters/minute is required to assure proper velocity levels. By regulating the hydrogen to oxygen ratios to stoichiometrically hydrogen-rich levels, not all the hydrogen is burned in the combustion chamber of the gun. This excess hydrogen appears to improve the quality of the coating by presenting a reducing environment for the gun's powder-carrying exhaust. There is a limit to the amount of excess hydrogen permitted, however. For example, with $O_2$ flow at 290 liters/minute; hydrogen flow in the neighborhood of 1050 liters/minute may cause sufficient build-up to plug the gun's nozzle and interrupt operation.

By utilizing hydrogen and oxygen as combustion gases wherein the gases are fed at pressures in excess of 80 psi to obtain oxygen flow rates between 240–290 liters/minute (270 liters/minute preferred) and $H_2/O_2$ mass flow rates in the ratio of 2.6/1–3.8/1, the gun's combustion exhaust gases are of sufficient velocity to accelerate the metal powders to supersonic velocities (in the order of 1,800–2,600 feet per second) and produce highly dense, low-oxide metal coatings of superior quality on a substrate.

Powder particle size is maintained within a narrow range of distribution normally between 10 microns and 45 microns. Starting oxygen content of the powder is maintained at less than 0.18% by weight for stainless steel powder and 0.06% for Hastelloy C. Proper exhaust gas velocities are established by a distinct pattern of shock diamonds in the combustion exhaust within the constraining tube 40 of the apparatus as heretofore described, exiting from the constraining tube at approximately 4,000–5,000 feet per second. Powder carrier gas preferably is nitrogen or other inert gas at a flow rate of between 35 to 90 liters per minute, while the inert shroud gas is preferably nitrogen or argon at 200–250 psi.

It is preferred that the gun be automated to move relative to the substrate or work piece to be coated at a rate in the order of 30 to 70 feet per minute and preferably 50 feet per minute, with a center line spacing between bands of deposited materials between ⅛ and 5/16 inches.

The distance from the tip of the gun nozzle to the substrate preferably is maintained between 6.5 and 15 inches with the distance between the outer end of the shroud's constraining tube and the work piece being in the order of one ½ to 7 inches; this latter distance being referred to in the art as "stand off" distance. Preferred shroud length (manifold plus constraining tube) is in the range of 6–9 inches.

Conventional thermal spray metal coatings such as produced by flame, wire arc, plasma, detonation and Jet Kote II processes typically exhibit porosity levels of 3% or higher. Normally such porosity levels are in the range of 5–10% by volume as measured on metallographic cross sections. Additionally oxide levels are normally high, typically in the range of 25% by volume and at times up to 50% by volume. The coating structures typically show non-uniform distribution of voids and oxides as well as non-uniform bonding from article to particle. Banded or lamellar structures are typical.

Figure 4:
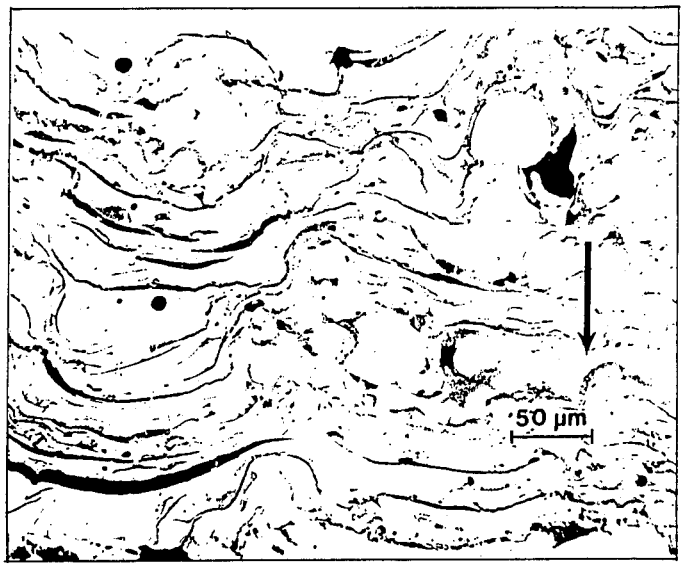
FIGS. 4–8 are a series of photomicrographs illustrating comparative characteristics of flame spray coatings.
Figure 5:
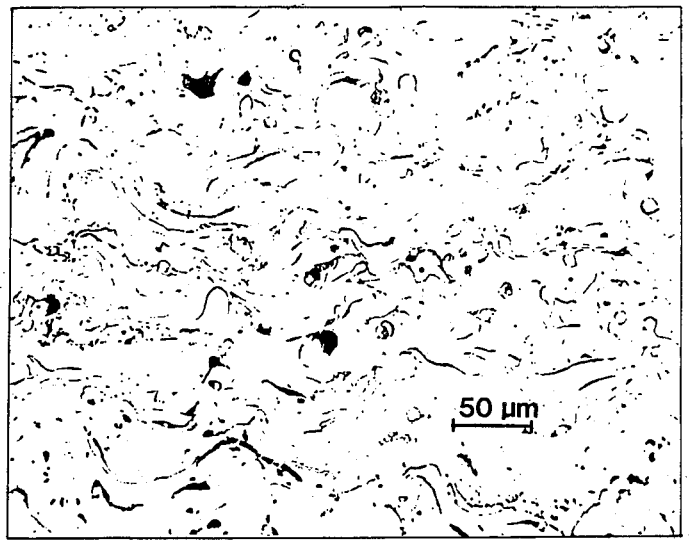
Figure 6:
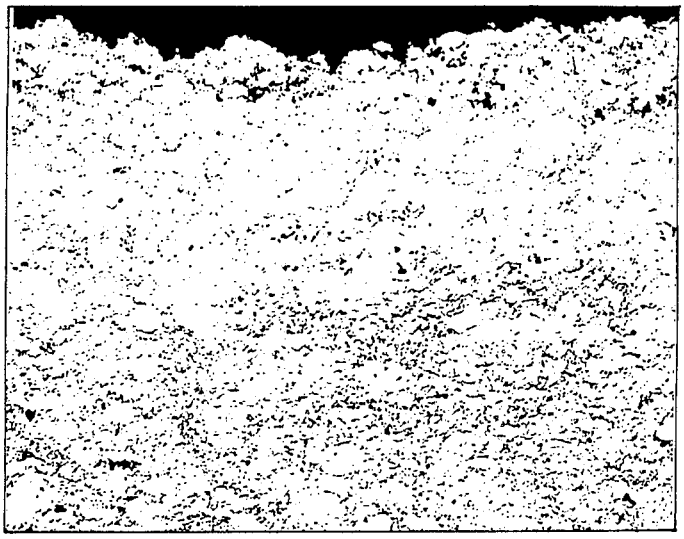

With particular reference to FIGS. 4–6 of the drawings, the aforenoted characteristics of conventional thermal spray coatings are illustrated.

The photomicrograph of FIG. 4 represents a metallographically polished cross-section of a 316L stainless steel coating produced by wire arc spraying. Large pores can be seen as well as wide gaps between bands of particles. Large networks of oxide inclusion also can be observed.

FIG. 5 represents a similar example of a Hastelloy C (nickel-base alloy) coating produced by conventional plasma spraying in air. A similar banded structure with porosity and oxide networks is obvious.

FIG. 6 illustrates an example of a 316L stainless steel coating produced by the Jet Kote II process in accordance with U.S. Pat. No. 4,370,538, aforenoted, using propylene as the fuel gas. The resulting coating exhibits a non-homogeneous appearnace and a high volume fraction of oxide inclusions.

Figure 7:
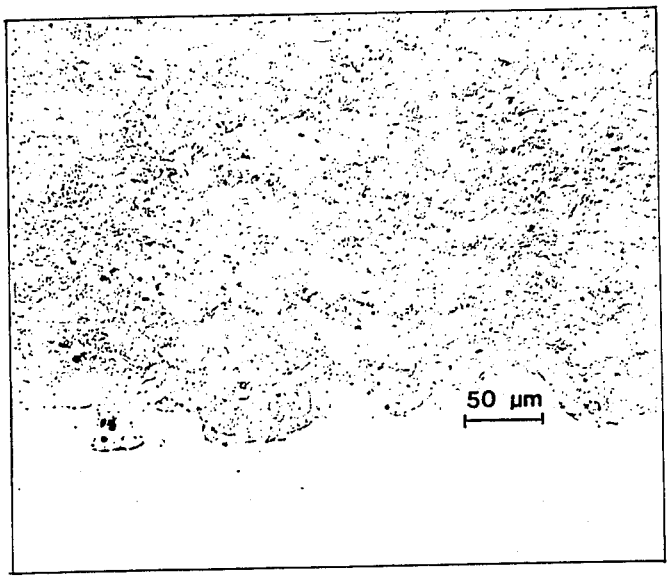
Figure 8:
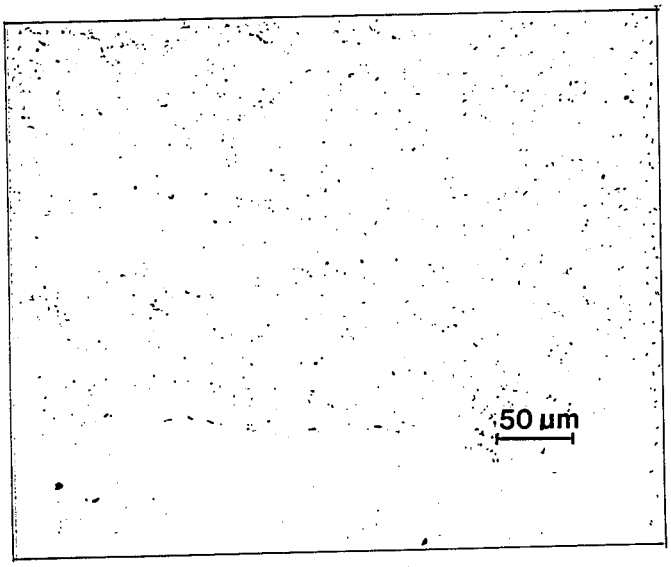

Significant improvements in density, cleanliness and uniformity of metal coating results from use of the hereinabove described process of this invention as shown in FIGS. 7 and 8.

FIG. 7 shows a metallographically polished cross-section of a Hastelloy C coating produced without an inert gas shroud, but other wise following the described process limitations as set forth. The total porosity and oxide level has been reduced, and the oxides are discrete (non-connected).

In comparison with FIG. 7, FIG. 8 shows a comparative cross-section of a Hastelloy C coating produced by the hereinabove described process using a helical flow inert gas shroud of argon gas. The total volume fraction of porosity and oxide inclusion in the coating of FIG. 8 has been further reduced to less than 1%.

Thermal spray coatings produced in accordance with the process hereof provide significantly more uniform, dense, less brittle, higher quality, protective coatings than obtainable by conventional prior art thermal spray methods. Advantageously, the process of this invention may be carried out in ambient air without the need for expensive vacuum or inert gas enclosures. Due to the nature of the shrouding apparatus, the spray gun can be made portable for use in remote locations.

Having described this invention it is believed that those familiar with the art will readily recognize and appreciate the novel advancement thereof over the prior art and further will understand that while the same has been described in association with a particular preferred embodiment the same is susceptible to modification, change and substitution of equivalents without departing from the spirit and scope thereof which is intended to be unlimited by the foregoing except as may appear in the following appended claims.

We claim:

1. In combination: a supersonic thermal-spray gun having a high pressure internal combustion chamber receptive of a continuous oxy-fuel mixture ignitable within said chamber, means for exhausting the hot gases of combustion from said chamber to an elongated nozzle having a converging inlet throat and an extended outlet bore, and means for introducing particulate materials, such as powdered metal, axially into the hot combustion gases flowing in said extended bore whereby to accelerate said particles to supersonic velocities upon exit from said bore; and elongated shroud means mounted to extend coaxially from said nozzle for receiving said hot gases and particles exiting therefrom; said shroud means comprising manifold means, plural nozzle means mounted on said manifold means, and open-ended constraining tube means attached to said manifold means for coaxial communication with said extended bore and operable to concentrically surround the hot gases and particles exiting from said nozzle; said manifold means operably distributing pressurized inert gas to said nozzle means for disscharge by the latter tangentially against the inner surface of said constraining tube means whereby to effect a helical flow of inert gas concentrically outwardly of said hot gases and particles to exclude ambient atmosphere therefrom.

2. The combination of claim 1, wherein said nozzle means are arrayed in a circular pattern concentrically about the central axis of said extended bore; said nozzle means being configured to direct inert gas discharged therefrom radially away from the hot gases and particles flowing coaxially of said constraining tube means whereby to minimize turbulation therewith.

3. The combination of claim 1 wherein said manifold means is detachably mounted over the outer end of the spray gun nozzle, and said constraining tube means is cylindrical and detachably connected to said manifold means.

4. The combination of claim 1 wherein each said nozzle means comprises a short tubular member having a medial bend arranged to direct inert gas supplied by said manifold means radially away from the axis of said bore.

5. Apparatus for use with a thermal-spray gun operable to provide an exhaust jet of supersonic velocity exiting from a nozzle having an elongated bore; said jet carrying particles to be deposited on a substrate, comprising: elongated shroud means having means for detachably securing the same to the outer end of said nozzle for reception of said jet and particles; said shroud means comprising manifold means and open ended constraining tube means supported by said manifold means for coaxial passage of said jet and particles therethrough; said manifold means comprising plural nozzle means constructed and arranged to distribute pressurized inert gas tangentially over the interior walls of said tube means whereby to effect a helically flowing shroud of inert gas radially outwardly of said jet to insulate the particles carried thereby from ambient atmosphere until the same are deposited on the substrate.

6. The apparatus of claim 5, wherein said tube means is cylindrical and is constructed with internal passageways for circulating cooling liquid therethrough.

7. Apparatus for use with a supersonic, thermal-spray gun having an elongated nozzle and means productive of a particle-carrying jet operable to heat and accelerate the particles to supersonic velocities prior to the deposit thereof on a substrate to be coated comprising:

elongated shroud means mounted to extend coaxially of the spray-gun nozzle for receiving the particle-carrying jet;

said shroud means comprising manifold means, plural nozzle means communicating with said manifold means, and open-ended constraining tube means attached to extend from said manifold means in coaxial communication with said spray gun nozzle to concentrically surround said particle-carrying jet;

said manifold means being operable to distribute pressurized inert gas to said nozzle means for discharge by the latter tangentially against the inner surface of said constraining tube means and radially away from said jet whereby to effect a helical flow of inert gas operable to isolate the particles carried by said jet from ambient atmosphere.

8. The apparatus of claim 7, wherein said inert gas is supplied at pressures of substantially 200–250 psi.

9. The apparatus of claim 7, wherein said shroud means is substantially 6 to 9 inches in length.

10. The apparatus of claim 7 and glow plug means mounted on said shroud means for igniting gases of combustion for said spray gun.

11. The apparatus of claim 7, wherein said tube means comprises a cylindrical metal member having water-cooled jacket means.

12. An improved method of producing a uniform, dense and substantially oxide-free metal coating on a substrate in ambient atmosphere by means of a high-velocity, thermal-spray gun apparatus of the type having a high pressure internal combustion chamber in which oxy-fuel gases are continuously supplied, ignited and exhausted therefrom to an outlet as a supersonic, particle-carrying exhaust gas jet, comprising the steps of:

burning oxygen and hydrogen gases in said combustion chamber at pressure sufficient to obtain a minimum oxygen flow rate of substantially 240 liters per minute and an hydrogen-to-oxygen mass flow ratio in the range of substantially 2.6–3.8 to 1;

introducing metal particles, having a particle size within the range of 10–45 microns and a low starting oxygen content, coaxially into the exhaust gas jet by means of an inert carrier gas; and providing a radially confining, helical flowing, pressurized inert gas shroud concentrically about said exhaust jet until the particles carried thereby impact the substrate.

13. The method of claim 13, wherein said oxygen flow rate is maintained within the range of 240–290 liters per minute.

14. The method of claim 12, wherein said inert carrier gas is maintained at a flow rate of substantially 35 to 90 liters per minute.

15. The method of claim 12 wherein said oxygen and hydrogen gases are fed to the combustion chamber at pressures in excess of 80 psi.

16. The method of claim 12 wherein the inert shroud gas is argon or nitrogen at pressures of 200–250 psi.

17. An improved method of depositing a uniform, dense and substantially oxide free metal coating on a substrate carried out by thermal-spray apparatus operating in ambient atmosphere to provide a supersonic-velocity jet stream of hot gases carrying metal particles to be impacted with a substrate to form the coating, comprising the steps of:

introducing metal particles having a particle size in the order of 10–45 microns and a low initial oxygen content coaxially into said jet stream by means of an inert gas carrier; and confining the particle-carrying jet stream within a shroud of helically flowing, pressurized inert gas maintained concentrically about said jet stream until the particles carried thereby impact the substrate; the gas shroud flowing with a radially outwardly directed component to minimize turbulation with said jet stream.

18. The method of claim 17 wherein said metal particles are fed into said jet stream at a rate of substantially 50–83 grams per minute.

19. The method of claim 17 wherein the initial oxygen content of the metal particles is less than 0.18% by weight.

20. The method of claim 17, and moving the gun relative to the substrate at a rate of substantially 30 to 70 ft/minute.

21. The method of claim 17 wherein the inert shroud gas is preferably argon or nitrogen at pressures of 200–250 psi.

22. Apparatus comprising:

manifold means for receiving and distributing pressurized inert gas;

means for securing said manifold means to the end of a nozzle that discharges a high temperature, particle-carrying stream at supersonic velocities;

an open-ended constraining tube means mounted on said manifold means for substantially coaxial passage of said particle-carrying stream therethrough; and plural nozzle means communicating with said manifold means for distributing pressurized inert gas substantially tangentially over the interior walls of said tube means in a manner to effect a helical flowing shroud of inert gas substantially concentrically about said particle-carrying stream within said tube means and operable upon exit from said tube means to isolate said particle-carrying stream from ambient atmosphere.

23. The apparatus of claim 22 wherein said inert gas is supplied at pressures of substantially 200–250 psi.

24. The apparatus of claim 22 wherein said tube means is substantially 6 to 9 inches in length.

25. The apparatus of claim 22 wherein means for igniting combustion gases exiting from said nozzle are mounted on said tube means.

26. The apparatus of claim 22 wherein said tube means comprises a cylindrical metal member having water-cooled jacket means.

* * * * *

UNITED STATES PATENT OFFICE

CERTIFICATE OF CORRECTION

Patent No. 4,869,936 Dated September 26, 1989

Inventor(s) Moskowitz et al.

It is certified that error appears in the above-identified patent and that said Letters Patent is hereby corrected as shown below:

| Column | Line | |
|---|---|---|
| 1 | 53 | "combuation" should read --combustion-- |
| 2 | 23 | "proces" should read --process-- |
| 2 | 44 | "temperature" should read --temperatures-- |
| 2 | 56 | "feed-stock" should read --feedstock-- |
| 2 | 63 | "1970's commercial" should read --1970's, commercial-- |
| 2 | 66 | "hig" should read --high-- |
| 3 | 5 | "wiht" should read --with-- |
| 5 | 57 | "respective" should read --receptive-- |
| 6 | 31 | "contraining" should read --constraining-- |
| 6 | 64 | "constraining and" should read --constraining tube and-- |

UNITED STATES PATENT OFFICE

CERTIFICATE OF CORRECTION

Patent No. 4,869,936 Dated September 26, 1989

Inventor(s) Moskowitz et al.

It is certified that error appears in the above-identified patent and that said Letters Patent is hereby corrected as shown below:

| Column | Line | |
|---|---|---|
| 10 | 17 | "Jet Kote" should read --JET KOTE-- |
| 10 | 24 | "article" should read --particle-- |
| 11 | 34 | "disscharge" should read --discharge-- |

Signed and Sealed this

Sixth Day of November, 1990

*Attest:*

HARRY F. MANBECK, JR.

*Attesting Officer*

*Commissioner of Patents and Trademarks*